US005963770A

United States Patent [19]

Eakin

[11] Patent Number: 5,963,770

[45] Date of Patent: Oct. 5, 1999

[54] PRINTING SYSTEM

[75] Inventor: Paul W. Eakin, Webster, N.Y.

[73] Assignee: Xerox Corporation, Stamford, Conn.

[21] Appl. No.: 09/166,403

[22] Filed: Oct. 5, 1998

[51] Int. Cl.[6] ..... G03G 15/00

[52] U.S. Cl. ..... 399/364; 399/16

[58] Field of Search ..... 399/16, 306, 361, 399/364, 374, 397, 401; 271/225, 287, 288, 289, 291, 184, 185, 186

[56] References Cited

U.S. PATENT DOCUMENTS

| | | | |
|---|---|---|---|
| 4,591,884 | 5/1986 | Miyamoto et al. | 399/374 X |
| 4,958,187 | 9/1990 | Tsuchiya et al. | 399/306 |
| 4,972,236 | 11/1990 | Hasegawa et al. | 399/361 X |
| 5,150,167 | 9/1992 | Gonda et al. | 399/361 X |
| 5,357,329 | 10/1994 | Ariyama et al. | 399/361 X |
| 5,568,246 | 10/1996 | Keller et al. | 399/382 |
| 5,598,257 | 1/1997 | Keller et al. | 399/364 |
| 5,730,535 | 3/1998 | Keller et al. | 400/605 |

*Primary Examiner*—Matthew S. Smith
*Assistant Examiner*—Hoan Tran
*Attorney, Agent, or Firm*—H. Fleicsher; J. E. Beck

[57] ABSTRACT

A printing system including three print engines. One of the print engines is non-operational while the other two print engines are operational. The non-operational print engine is redundant and only actuated in the event that one of the operational print engines develops a malfunction causing it to be non-operational. At that time, the previously non-operational print engine becomes operational. In this way, two print engines are continually in operation with one print engine being non-operational. This printing system significantly improves reliability and minimizes maintenance requirements.

11 Claims, 1 Drawing Sheet

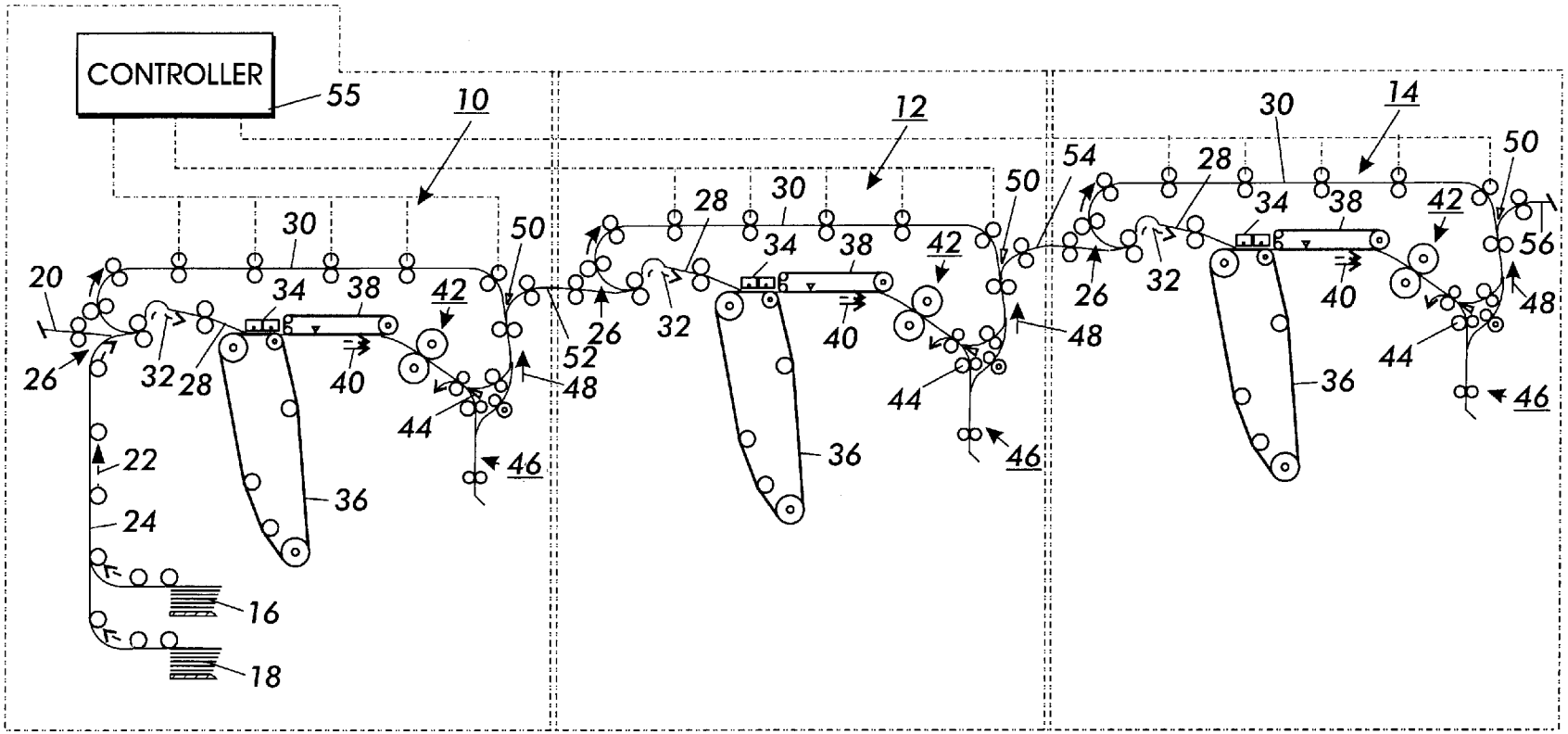
CONTROLLER
55
10
12
14
16
18
20
22
24
26
28
30
32
34
36
38
40
42
44
46
48
50
52
54
56

PRINTING SYSTEM

This invention relates to a printing system, and more particularly, concerns a plurality of print engines adapted to form duplex prints with one print engine being redundant and non-operable while the remaining print engines are operative.

A typical printing systems adapted for use in high speed printing employs two print engines arranged in tandem. Each print engine prints on one side of the sheet. In this way, duplex prints are formed rapidly and at a high productivity. Each print engine may be an electrophotographic print engine. These print engines are identical to one another and have a photoconductive member that is charged to a substantial uniform potential so as to sensitize the surface thereof. The charged portion of the photoconductive member is exposed to a light image of a document being printed. Exposure of the charged photoconductive member effectively dissipates the charge thereon in the irradiated areas to record an electrostatic latent image on the photoconductive member corresponding to the informational areas desired to be printed. After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to a sheet. Thereafter, the toner powder image is heated to permanently fuse it to the sheet. After the toner powder image has been formed on one side of the sheet, the sheet is advanced to the next print engine to have information printed on the other side thereof. The sheet may be inverted or the print engine may be oriented so as to print on the opposed side of the sheet. In any event, both print engines are substantially identical to one another and produce a sheet having information on opposite sides thereof, i.e., a duplex sheet. This is duplex printing. While electrophotographic print engines may be utilized, one skilled in the art will appreciate that any other type of print engines may also be used. For example, ink jet print engines, or lithographic print engines may be used. Furthermore, these print engines may be mixed and matched. Thus, the printing system does not necessarily require only electrophotographic print engines or only ink jet print engines or only lithographic print engines, but rather may have an electrophotographic print engine and an ink jet print engine, or any such combination.

In high volume duplex printing of mission critical customer jobs, down time associated with one of the print engines being non-operative is an extreme disaster. Hereinbefore, the customer frequently had two printing systems. One of the printing systems was in operation while the other printing system remained as a back-up. Thus, users in this market segment improved reliability by purchasing an entire printing system for use as a back-up unit. Also, they frequently require on-site service personnel.

There have been various approaches in the duplicating and printing field for printing on a first side and a second side of a sheet. In some instances, the print engines are arranged in straight-line tandem. Another approach has been to provide a sheet handling mechanism for inverting a sheet within one print engine so as to form duplex prints as a output therefrom such machines are more compact than the tandem arrangement. However, in either case, the reliability of the printing system tends to be of concern to the user. The following disclosures appear to be relevant to printing system using tandem print engines:

U.S Pat No. 5,568,246

Patentee: Keller, et al.

Issued: Oct. 22, 1996

U.S Pat. No. 5,598,257

Patentee: Keller, et al

Issued: Jan. 28, 1997

U.S. Pat. No. 5,730,535

Patentee: Keller, et al

Issued: Mar. 24, 1998

The references cited, U.S. Pat. No. 5,568,246; U.S. Pat. No. 5,598,257; and U.S. Pat. No. 5,730,535, disclose a printing system including two print engines arranged in tandem. Each print engine includes an inverter. The print engines are electrophotographic printing machines. As stated in U.S. Pat. No. 5,568,246; if one of the print engines fails, the other print engine can still be utilized. In this case, the normal single engine duplexing operation is used.

In accordance with one aspect of the features of the present invention, there is provided a printing system including a first print engine adapted to print information on either side of a sheet. A second print engine is adapted to print information on either side of the sheet as well. Finally, a third print engine is adapted to print information on either side of the sheet. The third print engine is non-operative in response to the first print engine and the second print engine being operative to print information on opposed sides of the sheet. The third print engine is operative, in response to either the first print engine or the second print engine being non-operative. The third print engine is adapted to print information on the side of the sheet opposed to the side of the sheet having information printed thereon by either the first print engine or the second print engine.

Other aspects of the present invention will become apparent as the following description proceeds and upon reference to the drawings, which is a schematic elevational view showing a printing system having three electrophotographic print engines arranged in tandem.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawing. In the drawing, like reference numerals have been used throughout to designate identical elements.

Referring to the drawing, there is shown a printing system having three electrophotographic printing machines arranged in tandem. The printing system includes print engine 10, print engine 12, and print engine 14. At any one time, only two print engines are operational. The print engines are identical to one another. Thus, the sheet having information printed thereon passes through two of the three print engines and bypasses the third non-operational print engine. In response to one of the operational print engines becoming non-operational, the previously non-operational print engine becomes operational. In this way, two print engines are always operational. The redundant print engine becomes operational when one of the operating print engines becomes non-operational due to a malfunction. It is thus clear that the printing system of the present invention employs two print engines in an operational mode and one print engine in a non-operational or back-up mode. This significantly improves reliability. Furthermore, each print engine is identical to each other, and engine commonality is maintained. This results in significant reliability improvements.

Turning now to the details of print engine 10, a sheet is supplied from feed trays 16 or 18 (or optional sheet input 20). The sheet from feed tray 16 or 18 is advanced in the direction of arrow 22 by transport 24. A gate 26 directs the sheet either to transport 28 or to bypass transport 30. When one print engine 10 is in the operational mode, gate 26 directs a sheet onto transport 28. Transport 28 moves the sheet in the direction of arrow 32 to transfer station 34. Transport 28 moves the sheet in a times relationship with respect to photoconductive belt 36 so that the toner image developed thereon advances in registration with the sheet at transfer station 34. Transfer station 34 includes corona generators which spray ions onto the back side of the sheet to transfer the toner powder image from photoconductive belt 36 to the sheet. Thereafter, transport 38 moves the sheet, in the direction of arrow 40, to fusing station 42. Here, the toner powder image adhering to the sheet is permanently fixed or fused to the sheet.

A previously described, photoconductive belt 36 is charged to a substantial uniform potential and then exposed to a light image of the document to be printed. This records an electrostatic latent image on photoconductive belt 36 which is developed with toner particles to form a toner powder image thereon. This toner powder image is transferred to the sheet at transfer station 34. The electrostatic latent image is formed by using a raster output scanner (ROS) which includes a laser imaging system. A laser imaging system is modulated by digital information received thereto.

After passing through fusing station 42, gate 44 deflects the sheet into inverter 46. The inverted sheet is then advanced from inverter 46, in the direction of arrow 48, to gate 50 which deflects the sheet along output path 52 to print engine 12. Print engine 12, operating in the same manner as print engine 10, prints the next set of information on the opposed side of the sheet forming a duplex print. The duplexed sheet exits print engine 12 at output path 54 and enters print engine 14. At this time, gate 26 of print engine 14 is positioned so as to deflect the sheet along the bypass transport 30. The duplexed sheet exits print engine 14 along output path 56 and moves to a finisher, compiler, or a stacker.

In the event print engine 10 is non-operational, print engine 12 and print engine 14 are operational. In this mode of operation, the sheet is deflected along bypass transport 30 of print engine 10 and enters print engine 12 to have information printed on one side thereof. Thereafter, the sheet, having information printed on one side thereof, outputs print engine 12 along path 54 and enters print engine 14. At this time, gate 26 of print engine 14 deflects the sheet away from bypass transport 30 so as to have information printed on the opposed side thereof at transfer station 34 of print engine 14. Thereafter, the sheet is advanced to fusing station 42 of print engine 14 and, subsequently, to output path 56.

In the alternative, print engine 12 may be non-operational and print engines 10 and 14 operational. In this mode of operation, the sheet has information printed on the first side thereof by print engine 10 and then enters print engine 12. Gate 26 of print engine 12 deflects the sheet along bypass transport 30 of print engine 12 to output path 54 where the sheet enters print engine 14. Inasmuch as the sheet has been inverted in print engine 10, print engine 14 prints information on the opposed side of the sheet resulting in a duplex print being exited along output path 56. Thus, it is clear that in this mode as well, information is printed on both sides of the sheet by utilizing two of the three print engines.

Controller 55 is in communication with print engines 10, 12, and 14. The controller transmits signals to each one of these print engines to actuate various electrical solenoids, sheet deflectors, motors and/or clutches in selected steps or sequences as programmed. Sheet path sensors or switches are connected to the controller and are coordinated therewith for sensing timing and controlling the positions of the sheet in each of the printing engines. In this way, the position of the sheet is kept track of and the operation of the respective print engine controlled. In operation, controller 55 may also determine a malfunction in one of the print engines and shut that print engine down automatically. In response to one of the print engines being shut down by controller 55, controller 55 actuates the non-operational print engine and adjusts the parameters within the other print engines to ensure that the sheet moves along the appropriate paths in the appropriately timed sequence. Alternatively, controller 55 may display on a graphic user interface an alert to an operator that one of the print engines is malfunctioning and being shut down. The operator would then actuate the other print engine manually. Finally, controller 55 may merely display a warning to the operator that one of the print engines is malfunctioning and the operator may then shut down that print engine and actuate the redundant or non-operational print engine.

The printing system architecture using three print engines also permits continuous production while one print engine is being serviced. This architecture permits all of the print engines of the same design, eliminating unique design requirements for the non-operating print engine.

In recapitulation, it is clear that the present invention is directed to a printing system employing three print engines arranged in tandem with one of the print engines being non-operational while the other two print engines are operational. In this way, the redundant or non-operational print engine may be actuated in response to one of the operational print engines developing a malfunction. This significantly increases reliability and ensures that high productivity is maintained on a continuous basis.

It is, therefore, apparent that there has been provided in accordance with the present invention, a printing system which fully satisfies the aims and advantages hereinbefore set forth. While this invention has been described in connection with a specific embodiment thereof, it is evident that many alternatives, modifications and variations will be apparent to those skilled in the art. For example, although electrophotographic print engines have been described, one skilled in the art will appreciate that any type of print engine may be utilized, such as an ink jet print engine or a lithographic print engine. Accordingly, it is intended to embrace all such alternatives, modifications and variations that fall within the spirit and broad scope of the appended claims.

I claim:

1. A printing system, including:

a first print engine adapted to print information on either side of a sheet;

a second print engine adapted to print information on either side of the sheet; and a third print engine adapted to print information on either side of the sheet; and a control system, in communication with said first print engine, said second print engine and said third print engine, said control system regulates said first print engine, said second print engine, and said third print engine so that said third print engine is non-operative in response to said first print engine and said second print engine being operative to print information on opposed sides of the sheet, said control system regulating said third print engine to be operative in response to either said first print engine or said second print engine being non-operative, said control system regulating said third print engine to print information on a side of a sheet opposed to the side of the sheet having information printed thereon by either said first print engine or said second print engine.

2. A printing system according to claim 1, further including a transport, associated with said third print engine, to enable the sheet to bypass said third print engine in response to said third print engine being non-operative.

3. A printing system according to claim 2, further including an inverter associated with said first print engine for inverting the sheet having information printed on one side thereof advancing to said second print engine.

4. A printing system according to claim 1, further including a transport, associated with said second print engine, to enable the sheet to bypass said second print engine in response to said second print engine being non-operative.

5. A printing system according to claim 4, further including an inverter associated with said first print engine for inverting the sheet having information printed on one side thereof advancing to said third print engine.

6. A printing system according to claim 1, further including a transport, associated with said first print engine, to enable the sheet to bypass said first print engine in response to said first print engine being non-operative.

7. A printing system according to claim 6, further including an inverter associated with said second print engine for inverting the sheet having information printed on one side thereof advancing to said third print engine.

8. A printing system according to claim 1, wherein:

said first print engine includes an electrophotographic printing machine;

said second print engine includes an electrophotographic printing machine; and said third print engine includes an electrophotographic printing machine.

9. A printing system according to claim 8, wherein said first electrophotographic printing machine prints on one side of the sheet, said second electrophotographic printing machine prints on the other side of the sheet, and said third electrophotographic printing machine prints on either side of the sheet.

10. A printing system according to claim 8, wherein a systems operator actuates said third electrophotographic printing machine in response to said first electrophotographic printing machine or said second electrophotographic printing machine being non-operational.

11. A printing system according to claim 8, said control system, in communication with said first electrophotographic printing machine, said second electrophotographic printing machine and said third electrophotographic printing machine, to actuate said third electrophotographic printing machine in response to said first electrophotographic printing machine or said second electrophotographic printing machine being non-operational.

* * * * *